United States Patent [19]

Kriefall et al.

[11] Patent Number: 4,824,092

[45] Date of Patent: Apr. 25, 1989

[54] APPARATUS FOR STACKING SHEETS

[75] Inventors: Horst Kriefall, Bad Hersfeld; Helmut Rohrbach, Ronshausen; Siegfried Fischer, Bad Hersfeld, all of Fed. Rep. of Germany

[73] Assignee: Babcock-Bsh Aktiengesellschaft, Krefeld, Fed. Rep. of Germany

[21] Appl. No.: 126,413

[22] Filed: Nov. 25, 1987

[30] Foreign Application Priority Data

Dec. 2, 1986 [DE] Fed. Rep. of Germany ..... 3641157

[51] Int. Cl.[4] ..... B65H 29/68

[52] U.S. Cl. ..... 271/183; 271/197

[58] Field of Search ..... 271/197, 196, 183, 310

[56] References Cited

U.S. PATENT DOCUMENTS

| | | | |
|---|---|---|---|
| 3,178,174 | 4/1965 | Schneider | 271/183 |
| 3,476,241 | 11/1969 | Ungerer | 271/197 X |
| 3,730,517 | 5/1973 | Norton | 271/183 |
| 4,030,727 | 6/1977 | Jeschke | 271/197 X |
| 4,285,513 | 8/1981 | Kwasnitza | 271/183 X |

*Primary Examiner*—Richard A. Schacher

*Attorney, Agent, or Firm*—Herbert Dubno

[57] ABSTRACT

The sailing and floating of the sheets which has occurred uncontrollably at certain speeds is avoided so that an exact stacking is permitted at high speeds. The vacuum conveyor is a vacuum belt conveyor whose vacuum box with circulating vacuum belts extends over the entire stacking location and the brake device. The brake device comprises an upper circulating belt supported by a vacuum chamber whose upper strand reaches up to the stacking location. Thus the sheets during the stacking process are guided precisely and do not float freely.

16 Claims, 4 Drawing Sheets

APPARATUS FOR STACKING SHEETS

FIELD OF THE INVENTION

Our present invention relates to an apparatus for depositing sheets in a stack, i.e. to an apparatus for stacking sheets of paper, posterboard, cardboard or the like.

BACKGROUND OF THE INVENTION

A stacking apparatus can comprise a horizontal vacuum conveyor whose feed path ends above a stacking location, a brake device below the feed path upstream of the stacking location including a vacuum chamber around which an air permeable feed member is circulated and a deflection device for deflecting the ends of the sheets from the vacuum conveyor to the brake device.

In numerous manufacturing processes, e.g. in the manufacture of impregnated paper sheets for covering plates or in the manufacture of plastic foil, it is necessary to continuously and precisely stack large sheets having an inherently unstable form at a high speed.

Since the sheets because of their instability may not be pushed over each other, a vacuum conveyor can be used on which the sheets can be conveyed suspended by the vacuum and from which they can be ejected by interrupting the vacuum. The required braking of the sheets upstream of the stacking location is effected by a brake device which engages the sheet ends. This brake device feeds sheets with considerably less speed than the vacuum conveyor. The sheet ends are pressed by a deflection device from the vacuum conveyor to the brake device.

This apparatus is described in German Printed patent application DE-OS No. 23 48 320. The vacuum conveyor comprises vacuum conveyor rollers or belts spaced from each other and extending along the feed path.

The intervening spaces are bridged by suspension strips with blower nozzles so that the sheets on this path are conveyed floating. A vacuum brake roller under the conveyor plane is spaced upstream from the stacking location.

The entering sheet ends are pressed against the vacuum braking roller with a deflection device comprising several cams or lifting members mounted on a common shaft. The last vacuum conveyor roller in the feed direction is mounted at the beginning of the stacking location. Its vacuum is periodically switched off so that the release of the sheet ends is improved. The sheets leaving the vacuum brake roller have a residual speed so that they slide until impacting on a stop.

A very large number of sheets may be be deposited with this apparatus but only at a limited speed. Large sheets (typical dimensions: 1500 to 6000 mm length, 500–4000 mm width) begin to sail and float at speeds of from about 150 m/Min. as they are conveyed in a suspended form on the conveyor and in the depositing device so that an edgewise exact stacking is no longer possible.

OBJECTS OF THE INVENTION

It is an object of our invention to provide an improved apparatus for stacking sheets.

It is also an object of our invention to provide an improved apparatus for stacking sheets with which large sheets can be stacked precisely at a higher speed, especially above 150 m/Min.

SUMMARY OF THE INVENTION

These objects and others which will become more readily apparent hereinafter are attained in accordance with our invention in a stacking apparatus comprising a horizontal vacuum conveyor whose feed path ends above a stacking location, a brake device below the feed path upstream of the stacking location including a vacuum chamber around which an air permeable feed member is circulated and a deflection device for deflecting the ends of the sheets from the vacuum conveyor toward the brake device.

According to our invention the horizontal vacuum conveyor is a vacuum belt conveyor with a vacuum box which extends in the feed direction over the brake device and completely over the stacking location and on whose underside, provided with vacuum openings, a plurality of circulating vacuum belts are located. The feed member of the brake device is a circulating brake belt whose upper stretch is supported by a permeable bounding surface of the vacuum chamber and which reaches to the stacking location.

The sheets are guided exactly to the end of the stacking process at its start by the vacuum belt conveyor and at its end by the brake belt. The stacking occurs so that the sheets are simultaneously pulled from the vacuum belts during the braking by the brake belt. During this process the sheet beginning is held fixed by the vacuum belt until the stack end is reached. The sheets never float freely.

As an additional advantage several sheets following each other can be braked by the brake belt so that the beginning of a following sheet interrupts the vacuum of the sheet leading it on the vacuum belt conveyor and thus assists in releasing the leading sheet from the vacuum belt conveyor.

Advantageously at least two circulating vacuum belts are provided with a plurality of holes and circulate spaced from each other. These vacuum belts are each positioned on two guide strips mounted on the underside of the vacuum box running parallel in the feed direction between which the vacuum openings of the vacuum box are located. Because of the guide strips the friction of the sheets on the vacuum box underside is substantially reduced. Simultaneously the distribution of the vacuum between the vacuum box and the sheets may be adjusted.

The friction of the sheets on the vacuum box underside is further reduced when a plurality of additional spacer strips running parallel between the guide strips are provided on the underside of the vacuum box.

In other examples of our invention different sheet widths can be used since the apparatus can adjust to sheets of different width. For example transversely slidable vacuum belts can be provided by (or adjacent) closable vacuum openings between the guide strips and by (or adjacent) additional closable vacuum openings between the guide strips and the adjacent spacer strips.

For energy economies and optimization of the stacking process by decreasing the vacuum in the feed direction the vacuum box can be divided into at least three independently evacuable vacuum zones. Naturally the vacuum in the zone furthest downstream can be reduced to help release the sheets.

A reduced belt tension and thus a reduced drive power consumption can be obtained when the underside of the vacuum box positioned adjacent the circulating belt is curved to match the sag of the vacuum belts in the feed direction.

In an especially advantageous example of a brake device the upper stretch of the brake belt comprises two adjacent portions inclined relative to each other. The upstream portion of this upper stretch climbs in the feed direction and the downstream portion of the upper stretch is either substantially horizontal or descends relative to the horizontal. The sheets are then properly exactly guided so that they can be pulled from the vacuum belt conveyor and stacked in an optimum way in a stack of sheets.

A deflection device with which the sheet ends sufficiently far along can be pressed or pushed to the brake belt comprises a revolving brush equipped with bristles on the circumference of the brush over a circumferential angle of from 180° to 270°.

The braking and pulling away of the sheets from the vacuum belt conveyor can be optimized by correct choice of the braking speed relative to the feed speed of the sheets on the vacuum belt conveyor. Advantageously the feed speed of the brake belt should be $\frac{1}{8}$ to 1/15 of the feed speed of the vacuum belt conveyor.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
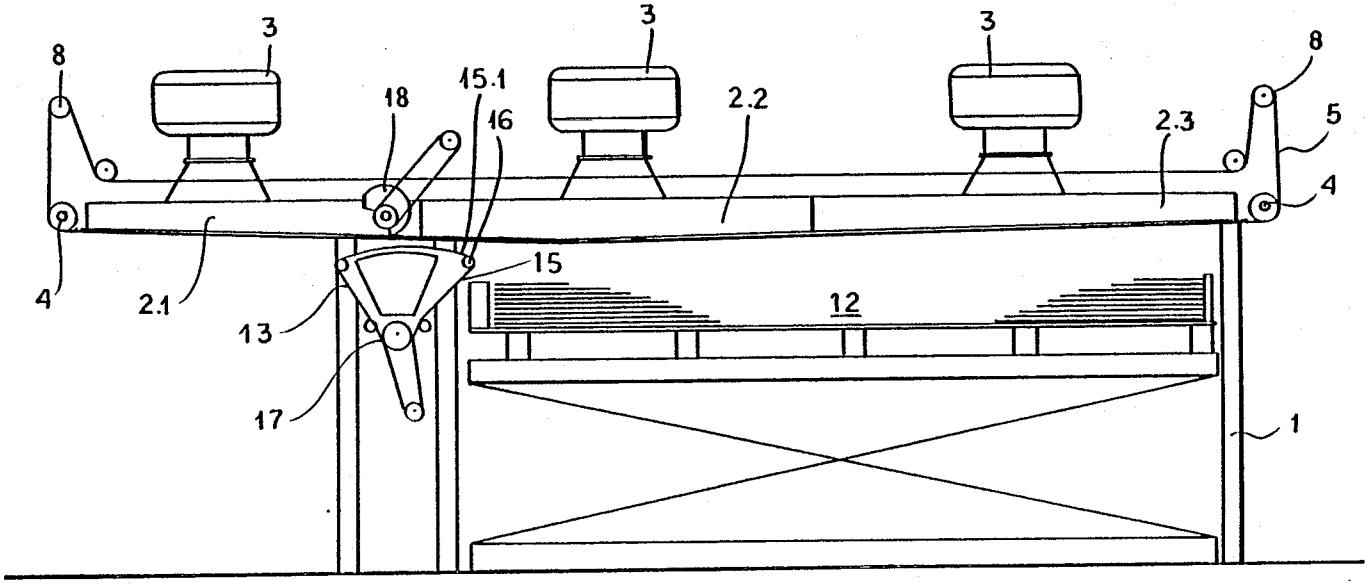
FIG. 1 is a side-elevational view of an apparatus for stacking sheets according to our invention.

As can be seen from FIG. 1 a stacking device according to our invention has a frame 1 on which a vacuum box 2 divided into three vacuum zones 2.1–2.3 along the feed direction is mounted vertically above the maximum stack height.

An independently controllable vacuum blower or pump 3 is connected to each vacuum zone 2.1–2.3.

Figure 3:
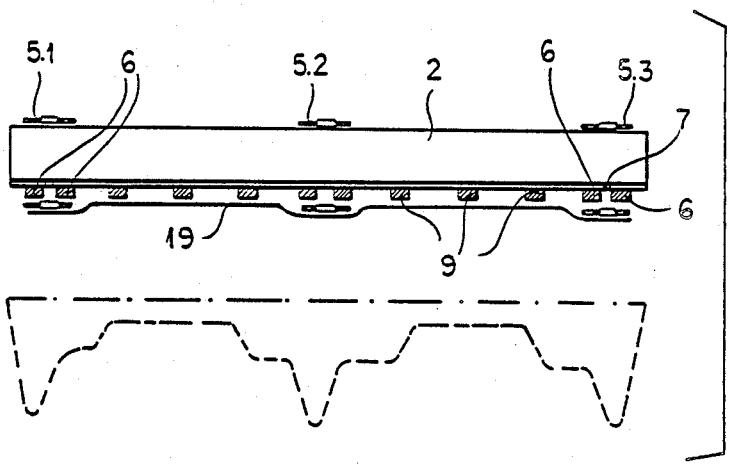
FIG. 3 is a cross sectional view through the vacuum belt conveyor with the vacuum distributed on a sheet.
Figure 4:
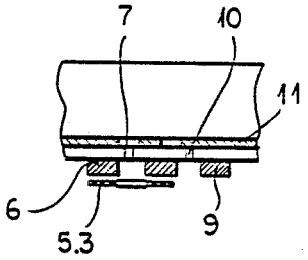
FIG. 4 is a cross sectional view of a portion of the vacuum belt conveyor which is adjustable to different sheet widths.

The width of the vacuum box 2 corresponds to the width of the sheet to be stacked. The sheet is displaced along the lower side in the feed direction —in FIG. 1 from left to right —as is apparent from FIG. 3 —by three vacuum belts 5.1–5.3 provided with elongated holes and driven over the rollers 4.

The lower stretch of each vacuum belt 5.1–5.3 rides on two parallel guide strips 6 mounted on the underside of the vacuum box 2. The vacuum box underside is provided with a plurality of vacuum openings 7 along the entire conveyor path between each pair of guide strips 6.

Two vacuum belts 5.1 and 5.3 run near the lateral edges of the vacuum box 2 while the vacuum belt 5.2 runs in the center of the vacuum box 2. These vacuum belts 5 are returned over guide rollers 8 positioned above the vacuum box 2. A plurality of spacer strips 9 are mounted on the underside of the vacuum box 2 between the pairs of guide strips 6 which maintain the sheets spaced from the vacuum box underside.

The guide and spacer strips 6 and/or 9 are not exactly positioned horizontally along the path of the sheet being conveyed but are somewhat curved downwardly to fit the sag of the vacuum belt 5. This is the case in the described embodiment because the individual vacuum zones 2.1 to 2.3 are not aligned but are somewhat inclined with respect to each other with their butt ends pushed together. Thus the guide strips 6 run along a section of the circumference of a ploygon.

Advantageously the outer vacuum belts 5.1 and 5.3 are slidable transversely and vacuum openings 10 are located between the interiorly located guide strips 6 and some of the adjacent spacer strips 9 also. The vacuum openings 7 and/or 10 which are not covered by the vacuum belt 5 may be closed by a transversely slidable perforated plate 11. The adjacent spacer strips 9 thus operate as guide strips in cases when sheets with a smaller width are to be stacked.

On the outlet side of the apparatus under the vacuum box 2 a stacking location 12 with a vertically adjustable stack table, e.g. a scissors lift table, is located. The feed path of the vacuum belt conveyor 2, 5 extends over the entire length of the stacking location 12.

Figure 2:
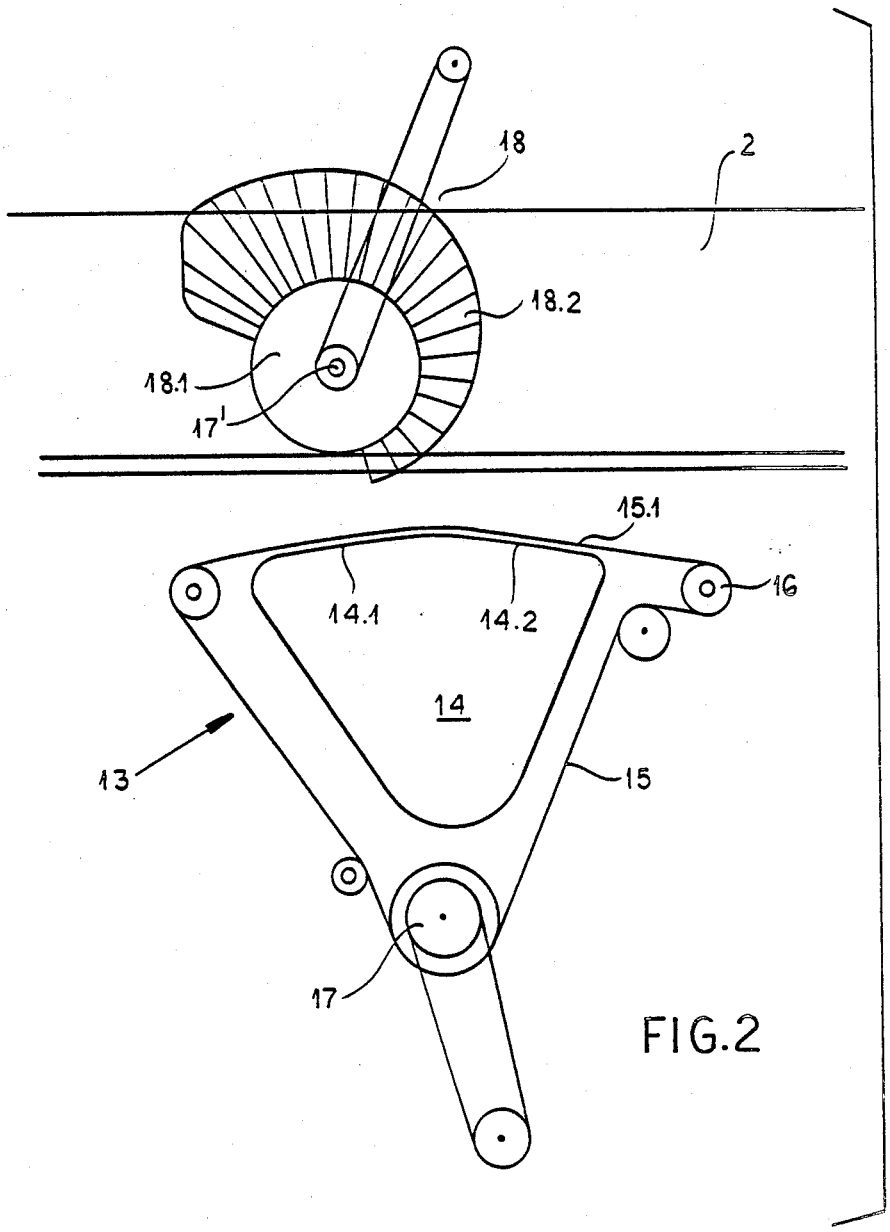
FIG. 2 is a magnified cutaway side-elevational view of a brake device with a revolving brush used in the apparatus according to our invention.

In the feed direction directly upstream of the stacking location 12 a brake device 13 is attached to the vertical upright members of the frame 1 under the vacuum box 2. This is illustrated to an enlarged scale in FIG. 2. The brake device 13 is formed by an evacuable vacuum chamber 14 extending transversely over the vacuum box width which is surrounded by three driven perforated belts (braking belts 15).

The cross section taken vertically through the vacuum chamber 14 has approximately the shape of a kite with rounded corners.

Both upper bounding surfaces 14.1 and 14.2 of vacuum chamber 14 —they support the upper stretch 15.1 of the brake belt 15 —are inclined somewhat relative to each other. The inlet side upper bounding surface 14.1 runs easily in the feed direction climbing relative to the horizontal.

The outlet side (or downstream) upper bounding surface 14.2 runs either horizontally or —as in this example gently downwardly inclined in the feed direction. Naturally the upper stretch 15.1 follows this bounding surface 14.2. The outlet side guide roller 16 of the upper stretch 15.1 of the brake belt 15 is directly located in front of or upstream of the stacking location 12.

The drive of the belt 15 occurs by a drive roller 17 under the vacuum chamber 14.

Above the climbing upper bounding surface 14.1 of the vacuum chamber 14 a driven shaft 17' is supported on the longitudinal supporting members of the frame 1 which supports the vacuum box 2. Three revolving brushes 18 sit on the shaft 17' distributed over the width of the vacuum box 2 in openings at appropriate locations.

Each revolving brush 18 comprises a cylindrical base body 18.1 and a plurality of bristles 18.2 extending radially attached to the periphery of the base body 1 over an angle of between 180° and 270°, in the present example 220°.

The revolving brushes 18 are arranged so that they disappear completely in the vacuum box 2 during a revolution and thus do not prevent the feed of a sheet 19 but also reach to the brake belt 15 at their greatest radial extent.

Figure 5:
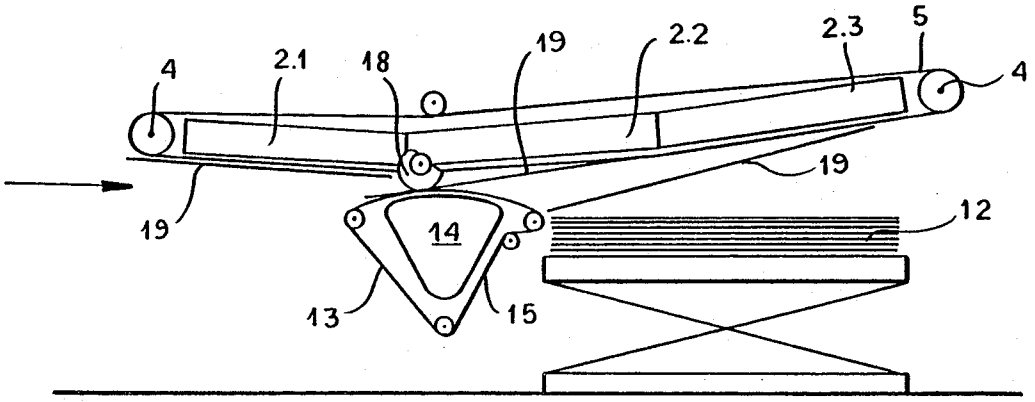
FIG. 5 is an enlarged side schematic view illustrating the stacking process.

To illustrate the operation of the stacking apparatus according to our invention FIG. 5 shows a moment during the stacking.

The sheets 19 to be stacked —in the present example paper sheets of about 5300 mm length and about 1800 mm width can be fed continuously from a conveyor (not shown) to the vacuum belt conveyor 2, 5. From this they are fed with a speed of about 240 m/Min to the stacking location 12 while being suspended by the vacuum on the vacuum belt 5. The rotational speed of the revolving brush 18 is synchronized with the speed of the vacuum belt 5 so that on feeding the sheet 19 into the region above the brake belt 15 the portion of the periphery not having the bristles 18.2 is directed downwardly, i.e. the brush 18 dips into the vacuum box 2.

If the sheet end has reached this region, it is struck or repelled by the bristles 18.2 rising at this time from the brake belt 15. The longest bristles 18.2 strike first on the sheet 19.

Since the suction forces of the brake belt 15 are adjusted to be larger than those of the vacuum belt conveyor 2,5 in this moment the sheet 19 is braked to the speed of the brake belt 15 which amount to only ⅛ to 1/15, in the present case 1/10, of that of the vacuum belt conveyor 2, 5. The sheets 19 are held at their front portion by the vacuum belt conveyor 2, 5. By the components of the brake force acting downwardly the sheets 19 are pulled away by their ends on further transport by the vacuum belt 5. The releasing is assisted by the following sheet 19 since in its as still unbraked feed it partially interrupts the vacuum of the leading sheet 19 with its sheet front end in the vicinity of the stack location 12 and helps peel it from the vacuum belt 5.

When the end of a sheet 19 has reached the end of the upper stretch 15.1 of the brake belt 15 —the stack location begins there —, the sheet beginning is located at the end of the stacking location 12 and has been immediately released from the vacuum belt 5. The sheet 19 is laid exactly edgewise on the stack whose height is adjusted to the position of the upper stretch 15.1 of the brake belt 15 by lowering the stack table.

To simplify the striking or ejection of the sheet ends and the releasing of the sheet beginning from the vacuum belt 5 the individual zones 2.1–2.3 of the vacuum box 2 are acted on with decreasing lower pressure in the feed direction.

The first vacuum zone 2.1 with the strongest vacuum extends to the vicinity of the revolving brush 18 to compensate the pressure loss occurring at the openings in the vacuum box 2.

An additional example of the stacking device according to our invention which is not illustrated has two stacking locations positioned in succession in the feed direction with a brake belt to allow removal of a completed stack during operation without significantly interrupting operation.

We claim:

1. In a stacking apparatus for stacking a plurality of sheets comprising a horizontal vacuum conveyor whose feed path ends above a stacking location, a brake device below said feed path upstream of said stacking location including a vacuum chamber around which an air permeable feed member circulates and a deflection device for deflecting the ends of said sheets from said vacuum conveyor to said brake device, the improvement wherein said horizontal vacuum conveyor is a vacuum belt conveyor with a vacuum box which extends in the feed direction over said brake device and completely over said stacking location and on whose underside provided with a plurality of vacuum openings a plurality of circulating vacuum belts are located and said feed member of said brake device is a circulating brake belt whose upper stretch is supported by a permeable bounding surface of said vacuum chamber and which reaches toward said stacking location, said deflection device comprising a revolving brush equipped with bristles over a circumferential angle of from 180° to 270°.

2. The improvement defined in claim 1 wherein at least two of said circulating vacuum belts are provided with a plurality of holes and circulate spaced from each other, each of said vacuum belts being positioned on two guide strips mounted on said underside of said vacuum box running parallel in said feed direction between which said vacuum openings of said vacuum box are located.

3. The improvement defined in claim 2 wherein a plurality of additional spacer strips running parallel between said guide strips are provided on said underside of said vacuum box.

4. The improvement defined in claim 3 wherein transversely slidable ones of said vacuum belts are provided near and by closable ones of said vacuum openings between said guide strips and near and by additional cosable ones of said vacuum openings between said guide strips and the adjacent ones of said spacer strips.

5. The improvement defined in claim 1 wherein said vacuum box is divided into at least three vacuum zones evacuable independently of each other.

6. The improvement defined in claim 1 wherein said underside of said vacuum box positioned adjacent said circulating belt is curved to fit the sag of said vacuum belts in said feed direction.

7. The improvement defined in claim 1 wherein said upper stretch of said brake brake belt comprises two adjacent portions inclined relative to each other, the upstream portion of said upper stretch climbing in said feed direction and the downstream portion of said upper stretch being either substantially horizontal or descending relative to said horizontal.

8. The improvement defined in claim 1 wherein the feed speed of said brake belt amounts to ⅛ to 1/15 of said feed speed of said vacuum belt conveyor.

9. A stacking apparatus for stacking a plurality of sheets comprising:

a horizontal vacuum belt conveyor whose feed path ends above a stacking location with a vacuum box which extends in the feed direction over said brake device and completely over said stacking location and on whose underside provided with a plurality of vacuum openings a plurality of circulating vacuum belts are located, at least two of said circulating vacuum belts are provided with a plurality of holes and circulate spaced from each other, each of said vacuum belts being positionable on two guide strips mounted on said underside of said vacuum box running parallel in said feed direction between which said vacuum openings of said vacuum box are located, and on whose underside also a plurality of additional spacer strips running parallel between said guide strips are provided on said underside of said vacuum box;

a brake device below said feed path upstream of said stacking location including a vacuum chamber having a permeable bounding surface around which an air permeable feed member is circulated which comprises a circulating brake belt whose upper stretch is supported by said permeable bounding surface of said vacuum chamber and which reaches to said stacking location, said upper stretch of said brake belt comprising two adjacent portions inclined relative to each other, the upstream portion of said upper stretch climbing in said feed direction relative to the horizontal and the downstream portion of said upper stretch being either substantially horizontal or descending relative to said horizontal; and a deflection device for deflecting the ends of said sheets from said vacuum conveyor to said feed member of said brake device, said deflection device comprising a revolving brush equipped with a plurality of radially directed bristles on the circumference of said revolving brush over a circumferential angle of from 180° to 270°.

10. In a stacking apparatus for stacking a plurality of sheets comprising a horizontal vacuum conveyor whose feed path ends above a stacking location, a brake device below said feed path upstream of said stacking location including a vacuum chamber around which an air permeable feed member circulates and a deflection device for deflecting the ends of said sheets from said vacuum conveyor to said brake device, the improvement wherein said horizontal vacuum conveyor is a vacuum belt conveyor with a vacuum box which extends in the feed direction over said brake device and completely over said stacking location and on whose underside provided with a plurality of vacuum openings a plurality of circulating vacuum belts are located and said feed member of said brake device is a circulating brake belt whose upper stretch is supported by a permeable bounding surface of said vacuum chamber and which reaches toward said stacking location, said upper stretch of said brake belt comprises two adjacent portions inclined relative to each other, the upstream portion of said upper stretch climbing in said feed direction and the downstream portion of said upper stretch being either substantially horizontal or descending relative to said horizontal.

11. The improvement defined in claim 10 wherein at least two of said circulating vacuum belts are provided with a plurality of holes and circulate spaced from each other, each of said vacuum belts being positioned on two guide strips mounted on said underside of said vacuum box running parallel in said feed direction between which said vacuum openings of said vacuum box are located.

12. The improvement defined in claim 11 wherein a plurality of additional spacer strips running parallel between said guide strips are provided on said underside of said vacuum box.

13. The improvement defined in claim 12 wherein transversely slidable ones of said vacuum belts are provided near and by closable ones of said vacuum openings between said guide strips and near and by additional closable ones of said vacuum openings between said guide strips and the adjacent ones of said spacer strips.

14. The improvement defined in claim 10 wherein said vacuum box is divided into at least three vacuum zones evacuable independently of each other.

15. The improvement defined in claim 10 wherein said underside of said vacuum box positioned adjacent said circulating belt is curved to fit the sag of said vacuum belts in said feed direction.

16. The improvement defined in claim 10 wherein the feed speed of said brake belt amounts to $\frac{1}{8}$ to 1/15 of said feed speed of said vacuum belt conveyor.

* * * * *